US006814408B2

(12) United States Patent
Chen

(10) Patent No.: US 6,814,408 B2
(45) Date of Patent: Nov. 9, 2004

(54) FOLDING CHAIR EQUIPPED WITH INFLATABLE WAIST PAD

(75) Inventor: Jimmy Ching Chen, Arcadia, CA (US)

(73) Assignee: Sportspower Limited, Kowloon (HK)

( * ) Notice: Subject to any disclaimer, the term of this patent is extended or adjusted under 35 U.S.C. 154(b) by 0 days.

(21) Appl. No.: 10/293,435

(22) Filed: Nov. 14, 2002

(65) Prior Publication Data

US 2004/0095006 A1 May 20, 2004

(51) Int. Cl.[7] ..... A47C 4/54

(52) U.S. Cl. ..... 297/284.6; 297/284.5; 297/284.4; 297/45; 297/16.2; 297/230.14

(58) Field of Search ..... 297/284.6, 284.5, 297/284.4, 284.1, 45, 219.1, 230.14, 162

(56) References Cited

U.S. PATENT DOCUMENTS 2,253,801 A * 8/1941 Neal ..... 5/710
4,108,492 A * 8/1978 Kirby ..... 297/284.3
4,518,200 A * 5/1985 Armstrong ..... 297/284.6
5,303,977 A * 4/1994 Sereboff ..... 297/230.1
5,329,751 A * 7/1994 Wadsworth ..... 54/23
6,082,813 A * 7/2000 Chen ..... 297/16.2
6,390,553 B1 * 5/2002 LeBlanc ..... 297/284.6
6,496,994 B1 * 12/2002 Omel et al. ..... 5/655.3
6,499,804 B1 * 12/2002 Wu ..... 297/381

* cited by examiner

*Primary Examiner*—Laurie K. Cranmer
(74) *Attorney, Agent, or Firm*—Birch, Stewart, Kolasch & Birch, LLP

(57) ABSTRACT

A folding chair equipped with inflatable waist pad comprises a plurality of pedestals located on the floor and a plurality of rods connecting pivotally to the pedestals to form a chair bracket. The chair bracket has a backrest section and a seat section to hold a seat cushion. The backrest section has a housing compartment to hold an inflatable waist pad. The chair bracket has two sides each has an armrest rod. When the inflatable waist pad is inflated and held in the housing compartment, the backrest section may be in close contact with the waist of an user sitting on the chair to comfort the waist muscles of the user.

8 Claims, 6 Drawing Sheets

FOLDING CHAIR EQUIPPED WITH INFLATABLE WAIST PAD

FIELD OF THE INVENTION

The present invention relates to a folding chair equipped with an inflatable waist pad and particularly a folding chair that is foldable to a small size to facilitate carrying and has a waist pad to provide support for user's waist.

BACKGROUND OF THE INVENTION

A conventional folding chair such as the one shown in FIG. 1 generally has four neighboring pedestals connecting by a plurality of main and secondary rods in a cross manner. The secondary rods have one end fastening to a displacement socket located on the main rods at two rear pedestals, and another secondary rod extended from the two rear pedestal is connect to the main rods on the front pedestals. The rods are interconnected to form a chair bracket. Then a seat cushion with a backrest and a seat is mounted onto the chair bracket, and two armrest bars are disposed on two sides to form a completed folding chair. Such a construction may be folded to a small size to facilitate carrying.

The backrest of the folding chair mentioned above is made from a pliable material to facilitate carrying. It cannot provide adequate support to the back of users during sitting, and is not comfortable. Moreover, human's vertebral column has three basic curves when erected: the cervical vertebrae has seven vertebrae bending and extending forwards, the chest vertebras has twelve vertebrae bending and extending rearwards and the waist vertebrae has five vertebrae bending and extending forwards. These curves must be balanced to enable people to sit comfortably without pain. The conventional folding chair such as the one mentioned before cannot match the forward angle of waist vertebrae due to the backrest made from a pliable material cannot be adjusted as desired. Moreover, people of different weights have different loads on the vertebrae. Sitting on the folding chair for a long period of time at improper postures tends to incur undue pressure on the spine nerve. As the spine nerve connects to various organs for transmitting messages, the spine nerve under pressure cannot function effectively to transmit messages, thus affects functioning of the organs. Some users try to remedy this problem by placing an auxiliary outfit such as a small pillow on the waist to maintain the correct forward bending angle for the waist vertebrae. While it helps to mitigate the pain on the waist, the pillow is inconvenient to carry when the chair is folded. In addition, the pillow tends to be squeezed unevenly and is slippery, and is prone to skew when in use and results in giving unbalanced support to user's waist. Thus instead of releasing the pain of users, it could cause suffering or fatigue to user's waist and back, and does not provide the comfort desired.

SUMMARY OF THE INVENTION

Therefore the primary object of the invention is to resolve the aforesaid disadvantages. The invention provides a folding chair equipped with an inflatable waist pad that is not only can be folded to a small size to facilitate carrying but also has a detachable and inflatable waist pad to fully match the natural curve of human spine to nudge the back of people to a correct position and to reduce the pressure on the vertebrae, and to provide a strong and comfortable support to the waist of users.

In order to achieve the foregoing object, the folding chair equipped with an inflatable waist pad of the invention includes a plurality of pedestals on the floor to couple with a plurality of rods to form a chair bracket. The chair bracket has a backrest section and a seat section to hold a seat cushion. The backrest section has a housing compartment to hold an inflatable waist pad. The chair bracket has two sides each has an armrest rod. When the inflatable waist pad is inflated and held in the housing compartment, it is in close contact with the waist of people sitting on the chair and gives waist muscles comfortable support.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
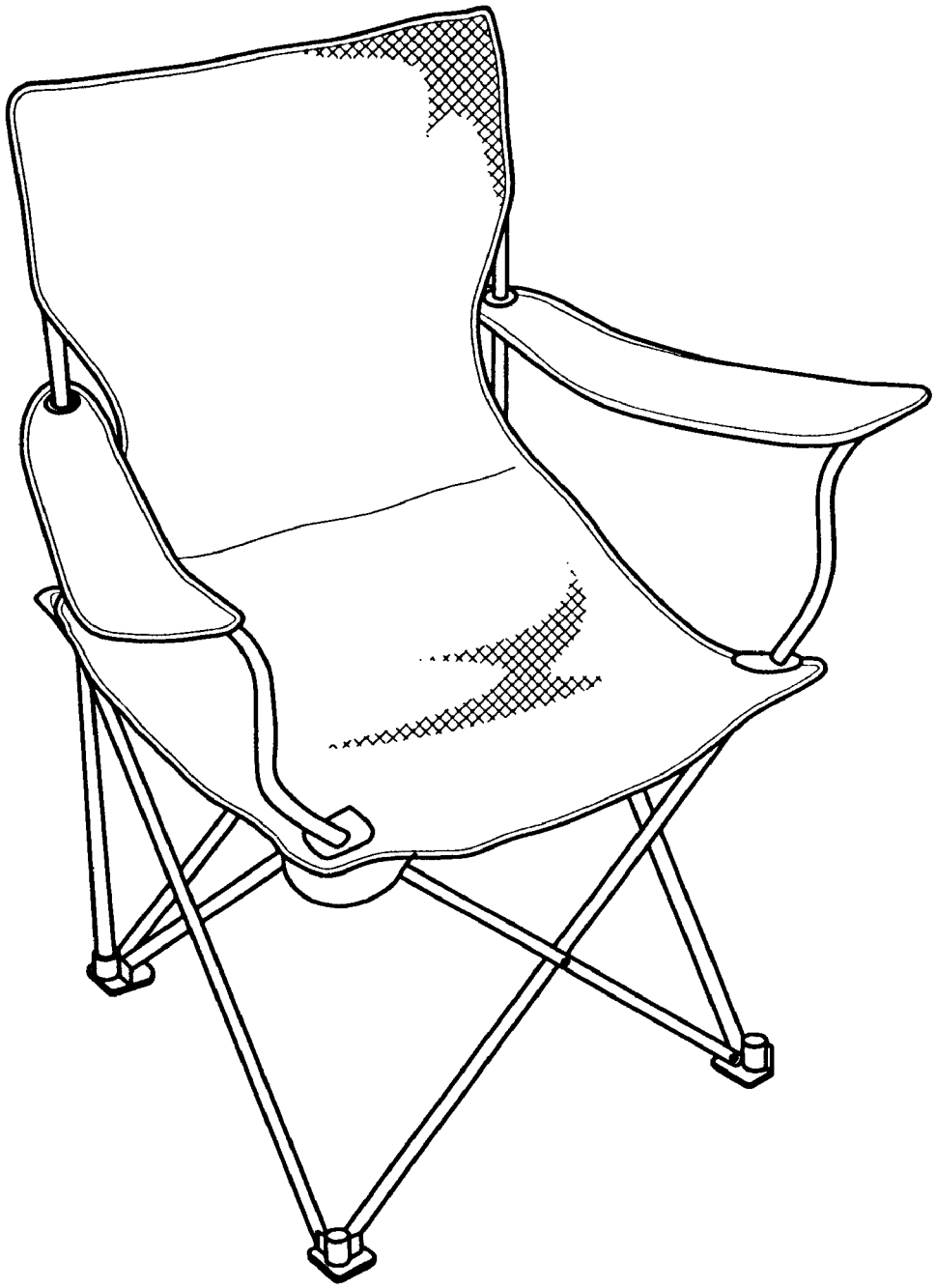
Fig.1 PRIOR ART
FIG. 1 is a perspective view of a conventional folding chair.
Figure 2:
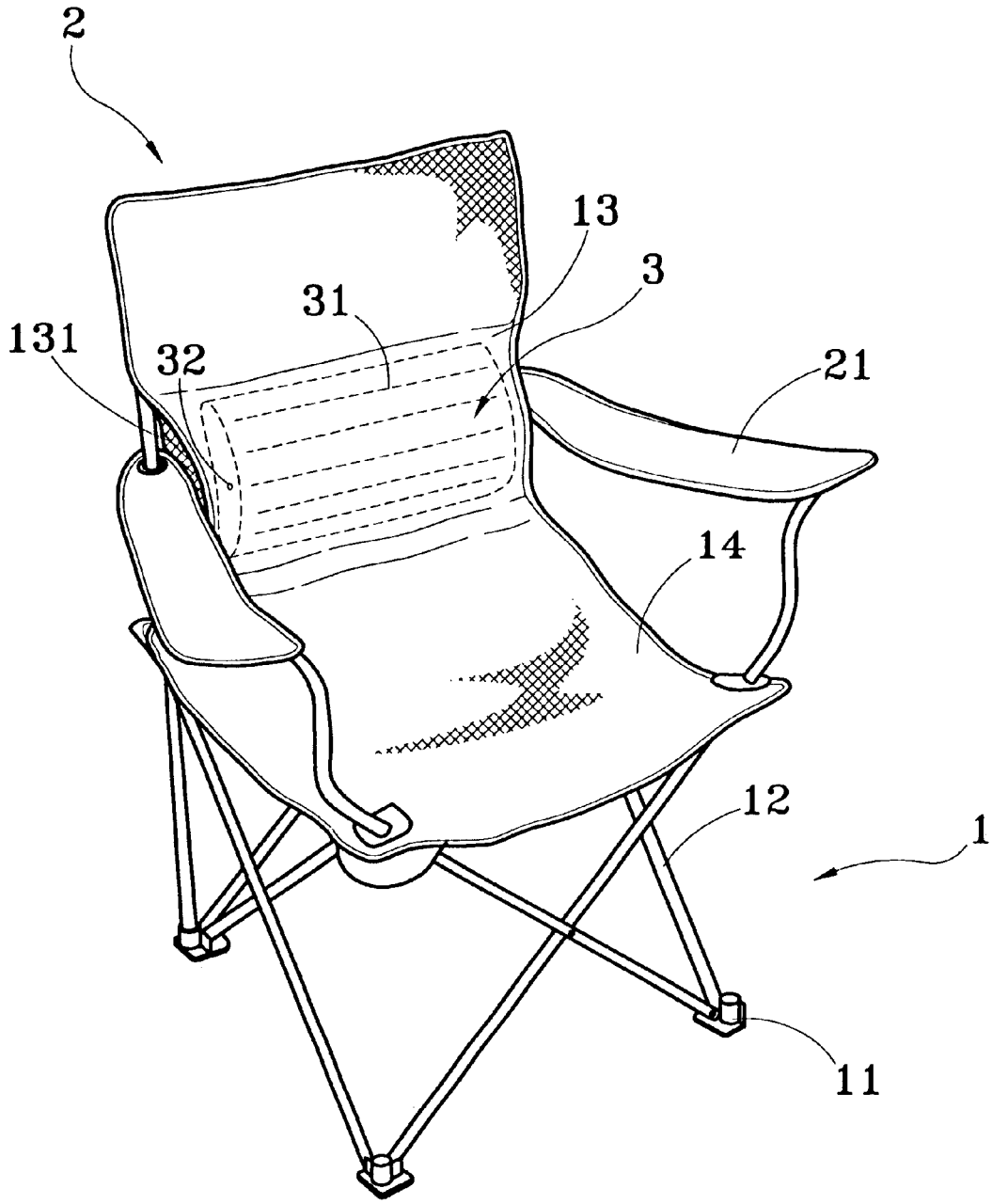
FIG. 2 is a perspective view of the invention.
Figure 3:
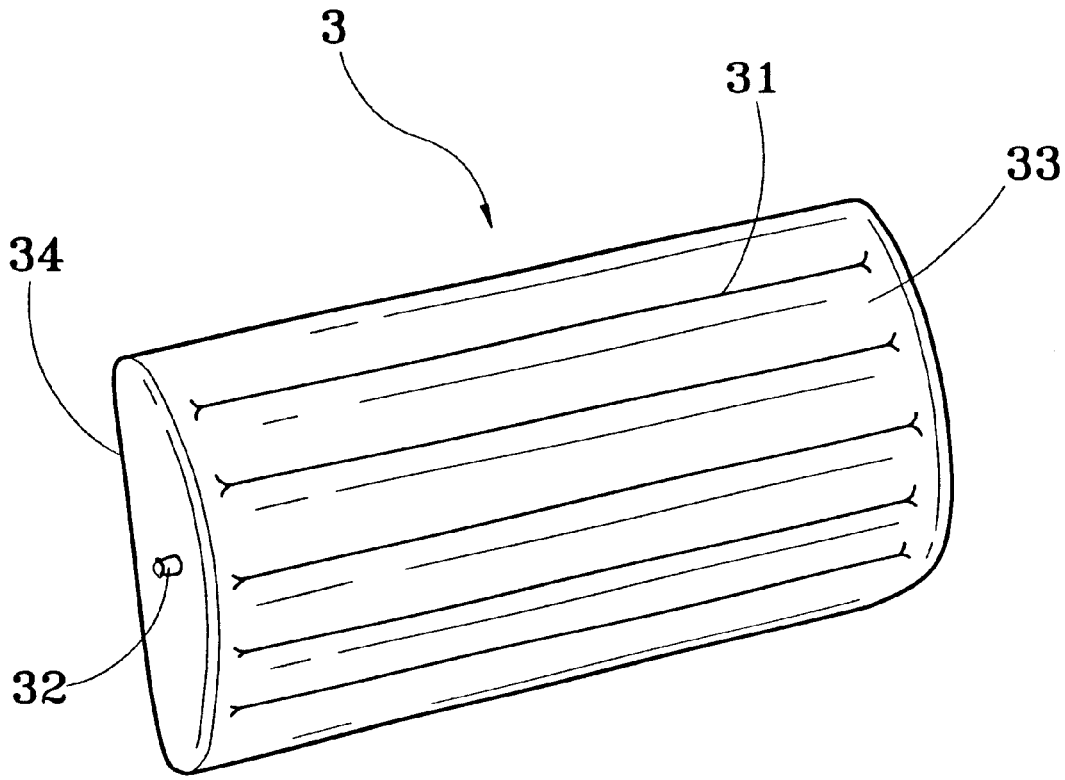
FIG. 3 is a perspective view of the inflatable waist pad of the invention.

Referring to FIGS. 2 and 3, the folding chair of the invention includes a plurality of pedestals 11 located on the floor and a plurality of rods 12 connecting pivotally to the pedestals 11 to form a chair bracket 1. The chair bracket 1 has a backrest section 13 and a seat section 14 to hold a seat cushion 2. The backrest section 13 has a housing compartment 131 to hold an inflatable waist pad 3. The chair bracket 1 has two sides each has an armrest rod 21. When the inflatable waist pad 3 is inflated and held in the housing compartment 131, the backrest section 13 may in close contact with the waist of the user sitting on the chair to comfort the waist muscles of the user.

The seat cushion 2 is mounted on the chair bracket 1 to extend to form the backrest section 13 and the seat section 14. The housing compartment 131 is located at a lower portion of the backrest section 13 for holding the inflatable waist pad 3.

The inflatable waist pad 3 is made from plastics that is airtight and light weight, and is especially designed according to the profile of human spine and has an bulged section 33 on one side to mate the forward bending waist vertebrae of human being. It has a flat surface 34 on another side to contact an inner side of the housing compartment 131. The surface of the inflatable waist pad 3 has a plurality of undulate strips to form an anti-slip section 31 to increase the surface roughness thereby to prevent the inflatable waist pad 3 from slipping in the housing compartment 131 and incurring unbalanced positioning when user's waist does not fully lean on the inflatable waist pad 3. This also may avoid sore waist and back and physical fatigue that might otherwise occur to users. The inflatable waist pad 3 further has an inflation valve 32 located on one side for inflating the inflatable waist pad 3 whenever desired. The inflation valve 32 may be opened to discharge air rapidly from the inflatable waist pad 3 and to shrink the size to facilitate carrying.

Figure 4A:
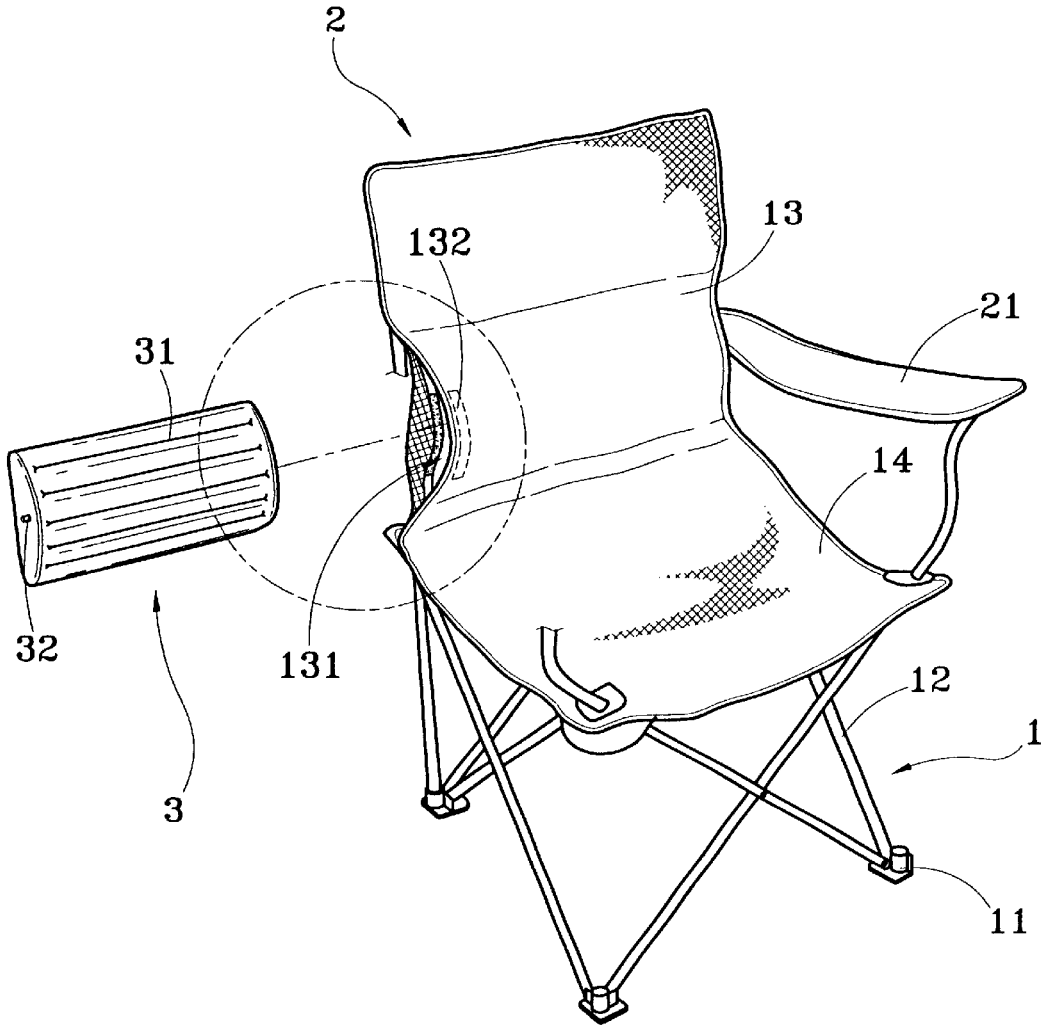
FIG. 4A is a schematic view of the invention for assembly.
Figure 4B:
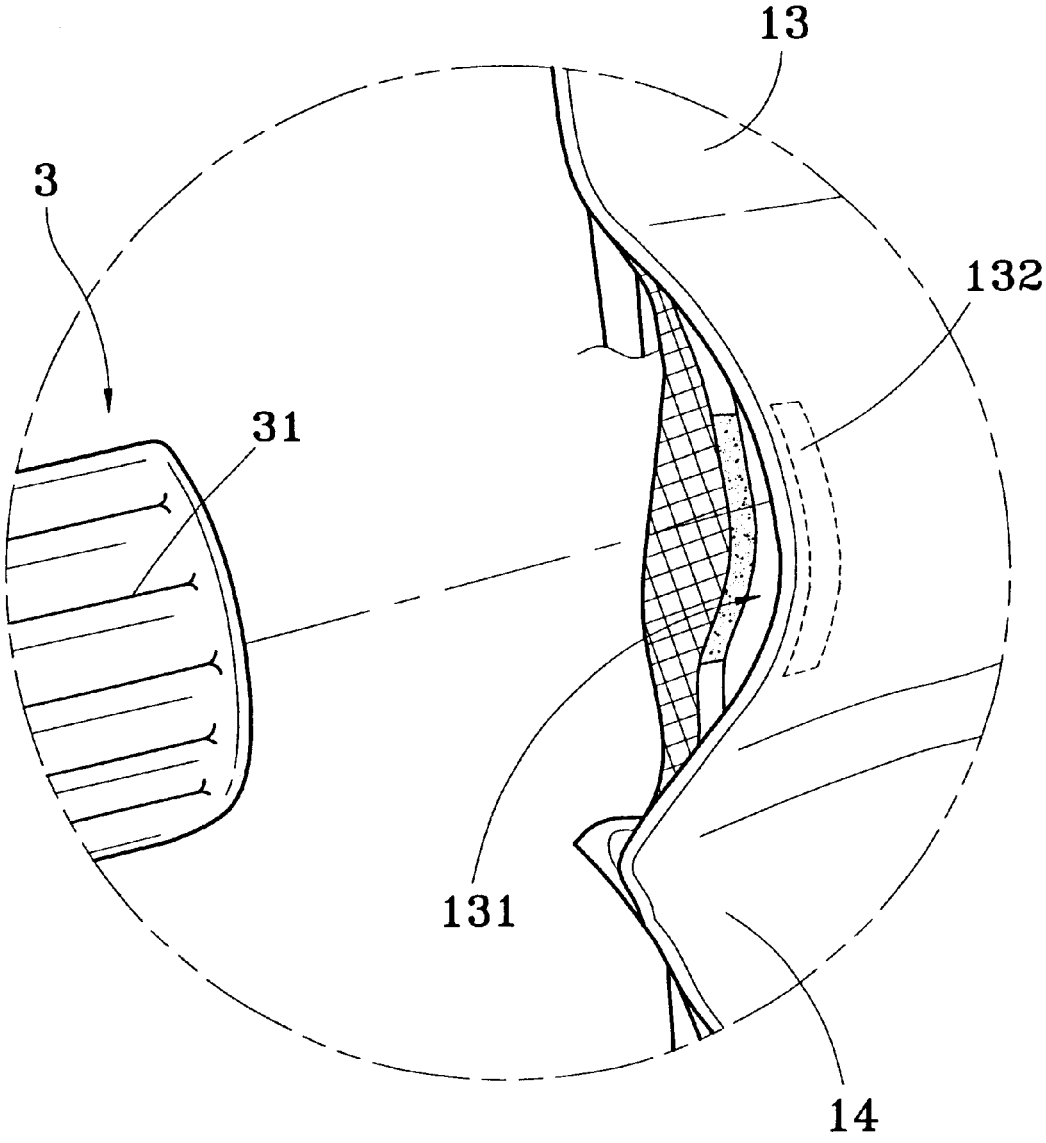
FIG. 4B is a fragmentary enlarged view of the invention.

Referring to FIGS. 4A and 4B, the housing compartment 131 on the backrest section 13 may have one end sealed and another end attached to a sealing element 132 for sealing. When the sealing element 132 is opened, the inflatable waist pad 3 may be disposed into the housing compartment 131 and the sealing element 132 may be closed to prevent the inflatable waist pad 3 from slipping out. The size of the housing compartment 131 mates the inflated inflatable waist pad 3 to prevent the inflatable waist pad 3 from slipping inside the housing compartment 131 or occurring unbalanced positioning inside the housing compartment 131 so that it can give user an even support on the waist without occurring sore waist or back or physical fatigue.

In addition, the design of the inflatable waist pad 3 allows users to make adjustment by inflation or deflection through the inflation valve 32 to suit their different physical figures and requirements. After the inflatable waist pad 3 is deflated as desired, the anti-slip section 31 on the surface of the inflatable waist pad 3 can prevent the inflatable waist pad 3 from slipping inside the housing compartment of the backrest section 13 to enable user's waist in close contact with the inflatable waist pad 3 all the time and provide user's waist desired stability and correct posture.

Figure 5:
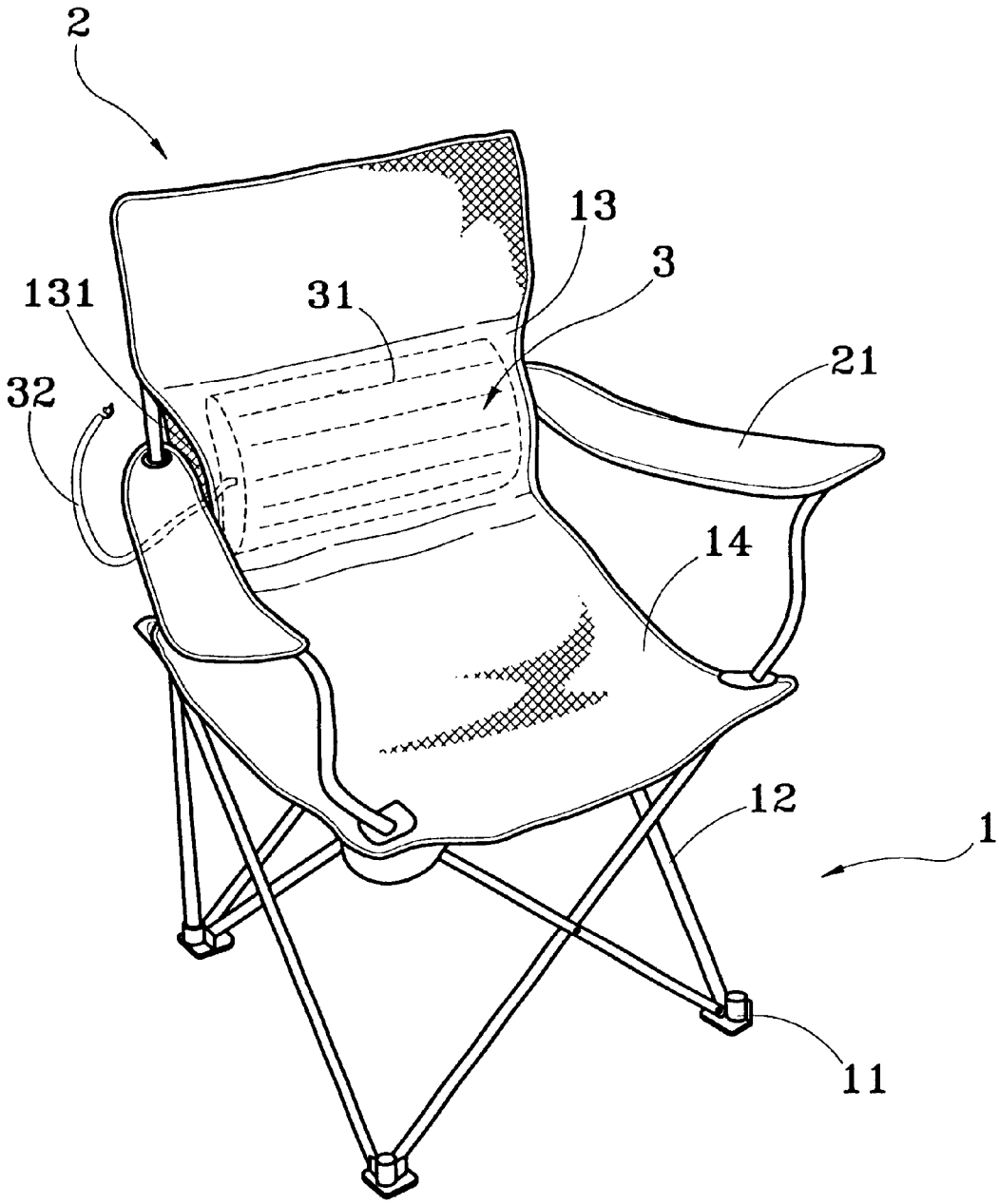
FIG. 5 is a schematic view of another embodiment of the invention.

Refer to FIG. 5 for another embodiment of the invention. The inflation valve 32 of the waist pad 3 may be a fine and elongated tube, and be extended outside from the housing compartment 131 of the backrest section 13 to enable users to inflate or deflate whenever needed to alter the size of the inflatable waist pad 3 to adjust the sitting depth.

In addition, the inflatable waist pad 3 may also be designed as a retrieval article, and the inflation valve of the inflatable waist pad 3 may be automatic inflating or be inflated through an auxiliary device. When to collapse the folding chair, first, remove the inflatable waist pad 3 from the housing compartment 131 of the backrest section 13; then open the inflation valve 32 to discharge the air from the inflatable waist pad 3. The deflated waist pad may be held in a storage bag (not shown in the drawings) with the folded chair to facilitate carrying.

Moreover, the two ends of the housing chamber 131 of the backrest section 13 may be open and be attached respectively to a sealing element 132.

Furthermore, the sealing element 132 may be a Velcro tape, a zipper, a ribbon, an adhesive tape, a latch hook, a magnet, a plurality of buttons, etc.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A folding chair equipped with inflatable waist pad, comprising:

a plurality of pedestals connecting to a plurality of rods to form a chair bracket, the chair bracket having a backrest section and a seat section;

a seat cushion located on the backrest section and the seat section, the backrest section having a housing compartment;

an armrest rod located on each of two sides of the chair bracket; and an inflatable waist pad located in the housing compartment of the backrest section;

wherein the inflatable waist pad is inflated and held in the housing compartment of the backrest section to be in close contact with the waist muscles and eliminate pain and fatigue resulting from sitting for a long period of time, and wherein the inflatable waist pad has an anti-slip section formed on the surface thereof.

2. The folding chair equipped with inflatable waist pad of claim 1, wherein the housing compartment of the backrest section has two opening ends which are sealed respectively by a sealing element.

3. The folding chair equipped with inflatable waist pad of claim 1, wherein the housing compartment of the backrest section has one end closed and another end opened and sealed by a sealing element.

4. The folding chair equipped with inflatable waist pad of claim 2 or 3, wherein the sealing element is selected from the group consisting of a Velcro tape, a zipper, a ribbon, an adhesive tape, a latch hook, a magnet and a plurality of buttons.

5. The folding chair equipped with inflatable waist pad of claim 1, wherein the inflatable waist pad is made from an airtight plastics.

6. The folding chair equipped with inflatable waist pad of claim 1, wherein the inflatable waist pad has a bulged section on one side and a flat surface on another side thereof.

7. The folding chair equipped with inflatable waist pad of claim 1, wherein the inflatable waist pad has an inflation valve located on one side thereof.

8. The folding chair equipped with inflatable waist pad of claim 1, wherein the inflation valve is automatic inflating or connected to an auxiliary inflating device for inflating.

* * * * *